US009448022B2

(12) United States Patent
Shreve

(10) Patent No.: US 9,448,022 B2
(45) Date of Patent: Sep. 20, 2016

(54) MAGAZINE FLOOR PLATE

(71) Applicant: C Products Defense, Inc., Bradenton, FL (US)

(72) Inventor: Bernie Shreve, Lakewood Ranch, FL (US)

(73) Assignee: C PRODUCTS DEFENSE, INC., Bradenton, FL (US)

( * ) Notice: Subject to any disclaimer, the term of this patent is extended or adjusted under 35 U.S.C. 154(b) by 25 days.

(21) Appl. No.: 14/331,373

(22) Filed: Jul. 15, 2014

(65) Prior Publication Data

US 2015/0276339 A1 Oct. 1, 2015

Related U.S. Application Data

(60) Provisional application No. 61/972,175, filed on Mar. 28, 2014.

(51) Int. Cl.
*F41A 9/71* (2006.01)
*F41A 11/00* (2006.01)

(52) U.S. Cl.
CPC *F41A 9/71* (2013.01); *F41A 11/00* (2013.01); *Y10T 29/49824* (2015.01)

(58) Field of Classification Search
CPC ..... F41A 9/65; F41A 11/00
See application file for complete search history.

(56) References Cited

U.S. PATENT DOCUMENTS 1,129,884 A * 3/1915 P. Mauser ..... F41A 9/65 42/50
1,365,234 A * 1/1921 Eickhoff ..... F41A 9/65 42/50
1,437,543 A * 12/1922 Ortgies ..... F41A 9/65 42/50
4,107,862 A * 8/1978 Sofinowski, III ..... F41A 9/65 42/50
5,642,582 A * 7/1997 Grams ..... F41A 9/65 42/50
6,055,758 A * 5/2000 Vieweg ..... F41A 9/65 42/7
7,093,386 B1 * 8/2006 Vieweg ..... F41A 9/65 42/7
2008/0028611 A1 * 2/2008 Chen et al. ..... F28D 15/0233 29/890.04
2011/0308128 A1 * 12/2011 Wright ..... F41A 9/65 42/50
2013/0019511 A1 * 1/2013 Plataniotis ..... F41A 9/65 42/6
2013/0227870 A1 * 9/2013 Rendulic ..... F41A 9/65 42/50
2013/0333261 A1 * 12/2013 Clifton, Jr. ..... F41A 9/65 42/50

* cited by examiner

*Primary Examiner* — Troy Chambers
*Assistant Examiner* — Bridget Cochran
(74) *Attorney, Agent, or Firm* — Bennett K. Langlotz; Langlotz Patent & Trademark Works, Inc.

(57) ABSTRACT

Magazine floor plates have a tubular body defining an elongated passage and having a lower end and an upper end, a floor plate element connected to the lower end, a follower movable within the elongated passage, a spring within the passage having a first end contacting the floor plate element, and having an opposed second end contacting and biasing the follower toward the upper end of the body. Downward force exerted by the spring on the floor plate element retains the floor plate element in an installed position relative to the lower end of the body. The floor plate element may have a width narrower than the elongated passage. The floor plate element may be connected to the lower end of the body by rails on the lower end of the body. The floor plate element may have an upward protrusion.

8 Claims, 9 Drawing Sheets

MAGAZINE FLOOR PLATE

FIELD OF THE INVENTION

The present invention relates to firearms, and more particularly to a magazine floor plate for a box magazine.

BACKGROUND OF THE INVENTION

A magazine is an ammunition storage and feeding device within, or attached to, a repeating firearm. The magazine functions by moving the cartridges stored in the magazine into a position where they may be chambered by the action of the firearm. Most magazines designed for use with a reciprocating bolt firearm utilize a set of feed lips which stops the vertical motion of the cartridges out of the magazine but allows one cartridge at a time to be pushed forward (stripped) out of the feed lips by the firearm's bolt into the chamber.

Some form of spring and follower combination is almost always used to feed cartridges to the lips, which can be located either in the magazine (most removable box magazines) or built into the firearm (fixed box magazines). As the firearm cycles, cartridges are moved to the top of the magazine by a follower driven by spring compression to a feed position. In most firearms, the magazine follower engages a slide-stop to hold the slide back and keep the firearm out of battery when the magazine is empty and all rounds have been fired. Box magazines may be integral to the firearm or removable.

A detachable box magazine is a self-contained mechanism capable of being loaded or unloaded while detached from the host firearm. They are inserted into a magazine well in the firearm receiver usually below the action, but occasionally positioned to the side or on top. When the magazine is empty, it can be detached from the firearm and replaced by another full magazine. This significantly speeds the process of reloading, allowing the operator quick access to ammunition.

Conventional pistol box magazines, such as the prior art 45 ACP magazine 100 shown in FIG. 1, have a spring plate 116 with a downwardly protruding pin 120 that protrudes into a hole 122 in the floor plate 118 to prevent removal of the floor plate. In order to remove the floor plate from the magazine body 112, a punch (not shown) is used to press upwards on the button to disengage the spring plate from the floor plate. The magazine floor plate can then be slid forward toward the front of the magazine and disengaged from the rails 124 on the bottom 126 of the magazine. This process has the disadvantage of requiring a tool in order to remove the floor plate. There is also a risk of forcible ejection of the spring plate by the compressed magazine spring 114 once the floor plate is disengaged from the magazine. Conventional 45 ACP magazines are also limited to seven rounds because the spring plate and follower occupy a portion of the interior volume of the magazine.

Conventional rifle box magazines, such as the prior art AR-15 magazine 200 shown in FIGS. 2A & 2B, has a floor plate 214 with an upward protrusion 218 near the front 216. The upward protrusion limits forward movement of the floor plate with respect to the magazine body 212. The floor plate is the same width as the magazine body. In order to remove the floor plate, a screwdriver 222 is inserted into the gap 224 between the front edge 226 of the floor plate and the bottom edge 228 of the magazine 212. The floor plate is thin and flexible enough that the front edge of the floor plate is pushed down to flex the floor plate so the upward protrusion can clear the front edge of the magazine body as the floor plate is pried forward. This is enabled by the bent tabs that support the plate from below being spaced away from the front face of the magazine, providing an elongated flexible cantilever that give significant flexing to allow the protrusion to clear the front edge. The floor plate can then be slid forward to disengage the floor plate from the tabs 220 on the bottom of the magazine. Also, the magazine body is directly above the plate about the entire periphery, so that it cannot be pressed upward into the opening, even in the absence of spring pressure, and must be flexed to clear the protrusion.

It is often desirable to increase the carrying capacity of a magazine. This is sometimes achieved by adding an extension to the lower end of the magazine, but this is often considered undesirable. Existing attempts to add capacity may exploit marginal available space while keeping convention floor plate dimensions, but this can have disadvantages. For instance, eight-round magazines are offered for conventional Model 1911 pistol single-stack magazines without an extension, but these pack the rounds in so tightly that they do not let the rounds depress. As a result, a loaded magazine may be installed only when the pistol slide is retracted, because loading a full magazine when the slide is closed requires the stripper on the slide to be able to depress the rounds slightly. Consequently, such magazines are unable to carry eight rounds plus one in the chamber of the associated firearm.

Therefore, a need exists for a new and improved magazine floor plate that can be removed from a magazine without tools, eliminates the need for a spring plate, and enables a magazine to carry eight rounds with an additional round in the associated firearm's chamber. In this regard, the various embodiments of the present invention substantially fulfill at least some of these needs. In this respect, the magazine floor plate according to the present invention substantially departs from the conventional concepts and designs of the prior art, and in doing so provides an apparatus primarily developed for the purpose of providing a magazine floor plate that can be removed from a magazine without tools, eliminates the need for a spring plate, and enables a magazine to carry eight rounds with an additional round in the associated firearm's chamber.

SUMMARY OF THE INVENTION

The present invention provides an improved magazine floor plate, and overcomes the above-mentioned disadvantages and drawbacks of the prior art. As such, the general purpose of the present invention, which will be described subsequently in greater detail, is to provide an improved magazine floor plate that has all the advantages of the prior art mentioned above.

To attain this, the preferred embodiment of the present invention essentially comprises a tubular body defining an elongated passage and having a lower end and an upper end, a floor plate element connected to the lower end, a follower movable within the elongated passage, a spring within the passage having a first end contacting the floor plate element, and having an opposed second end contacting and biasing the follower toward the upper end of the body. Downward force exerted by the spring on the floor plate element retains the floor plate element in an installed position relative to the lower end of the body. The floor plate element may have a width narrower than the elongated passage. The floor plate element may be connected to the lower end of the body by rails on the lower end of the body. The floor plate element may have an upward protrusion. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
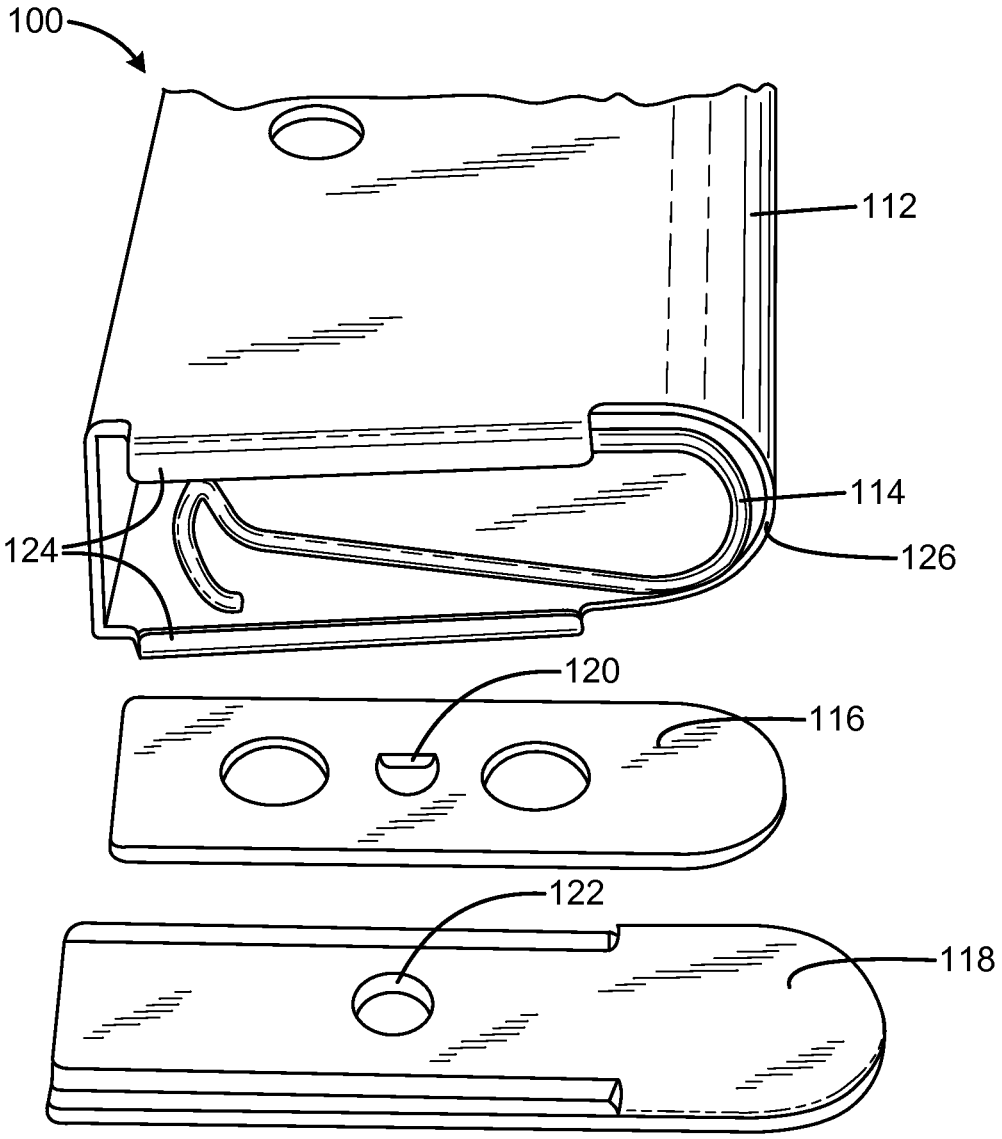
FIG. 1 PRIOR ART
FIG. 1 is a bottom perspective fragmentary exploded view of a prior art 45 ACP magazine.
Figure 2A:
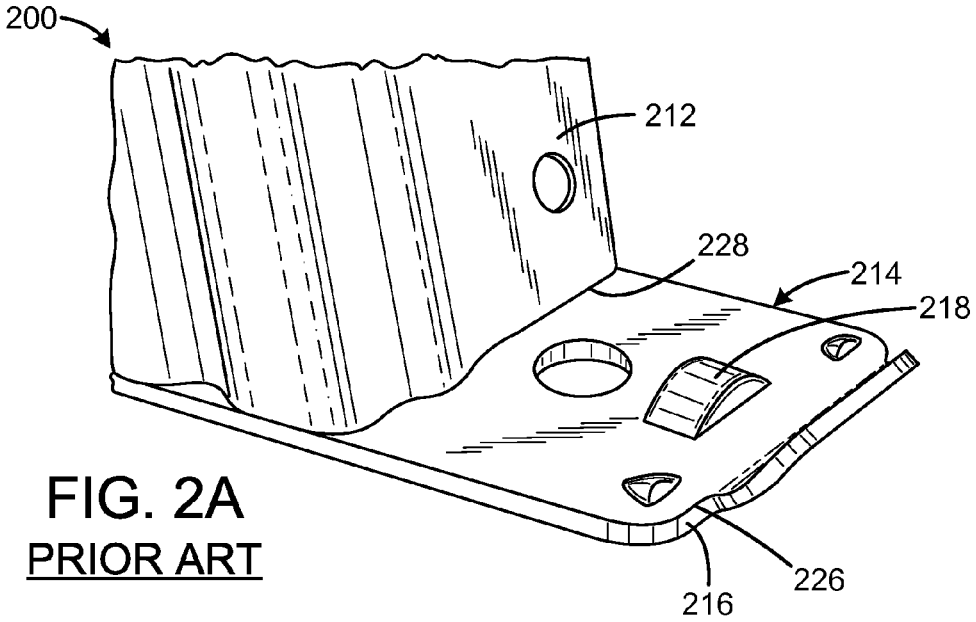
FIG. 2A PRIOR ART
FIG. 2A is a top perspective fragmentary view of a prior art AR-15 magazine with the floor plate partially removed.
Figure 2B:
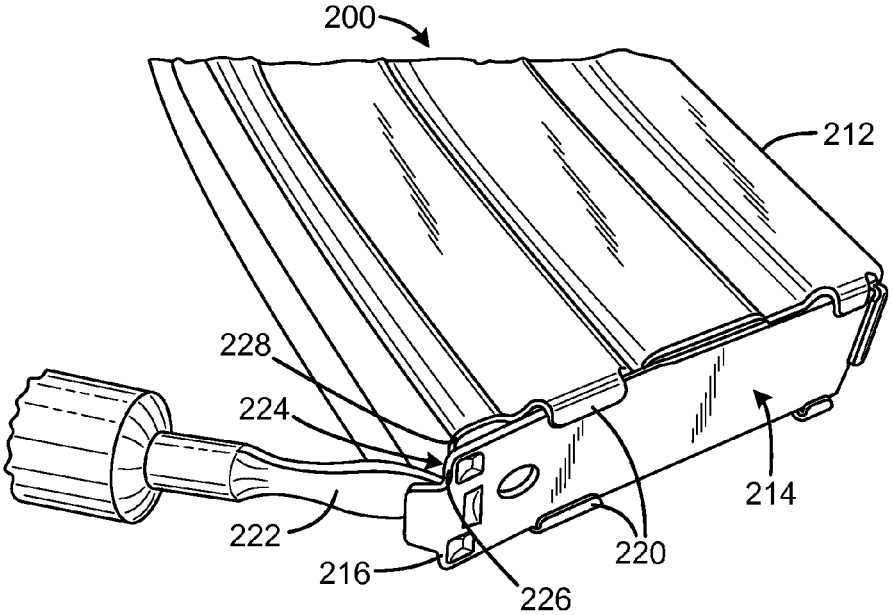
FIG. 2B PRIOR ART
FIG. 2B is a bottom perspective fragmentary view of the prior art AR-15 magazine of FIG. 2A.

An embodiment of the magazine floor plate of the present invention is shown and generally designated by the reference numeral 10.

Figure 3B:
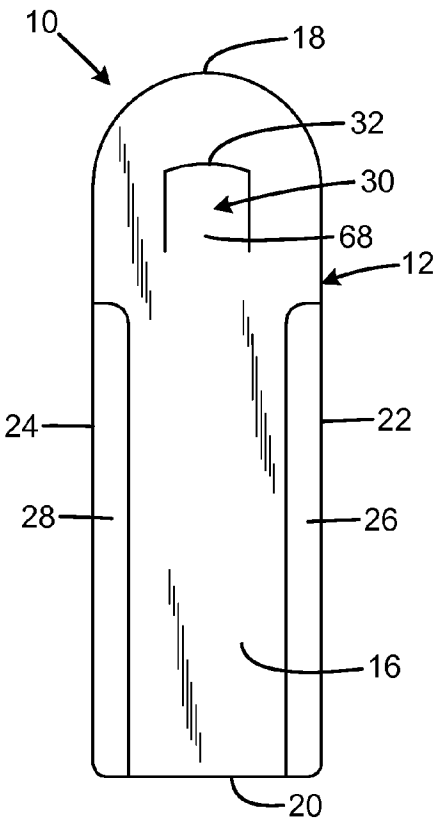
FIG. 3B is a bottom view of the magazine floor plate of FIG. 3A.
Figure 3A:
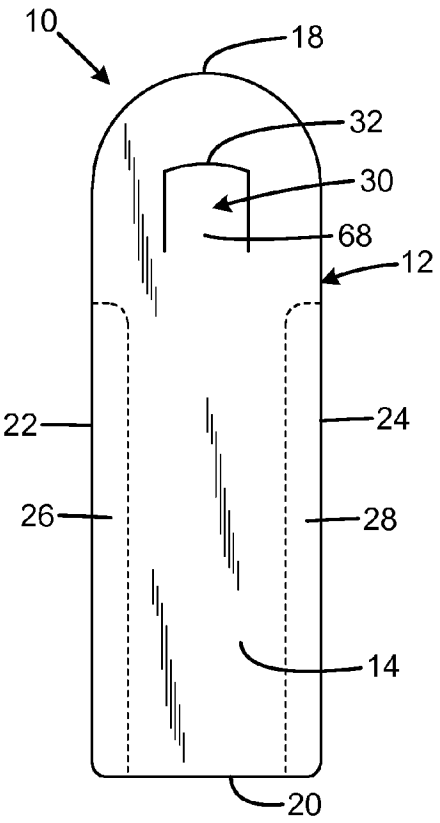
FIG. 3A is a top view of the current embodiment of the magazine floor plate constructed in accordance with the principles of the present invention.

FIGS. 3A & 3B illustrate the improved magazine floor plate 10 of the present invention. More particularly, the magazine floor plate 10 is a substantially planar body 12 having a top 14, bottom 16, front 18, rear 20, left side 22, and right side 24. An upwardly protruding latch tab 30 is located near the radiused front of the floor plate. The latch tab is oriented so the front 32 is a sharp step relative to the top of the body, and the top 68 of the latch tab forms a gentle rearward-facing slope. The left side defines a left groove 26, and the right side defines a right groove 28. The left and right grooves begin rearward of the latch tab and extend to the rear of the body. In the current embodiment, the latch tab is lanced in the body (the lance tool cuts through the body, but does not remove the material to leave a through hole). The left and right grooves are coined in the bottom of the body in the current embodiment. In the current embodiment, the magazine floor plate is rigid, and preferably made of metal.

Figure 4A:
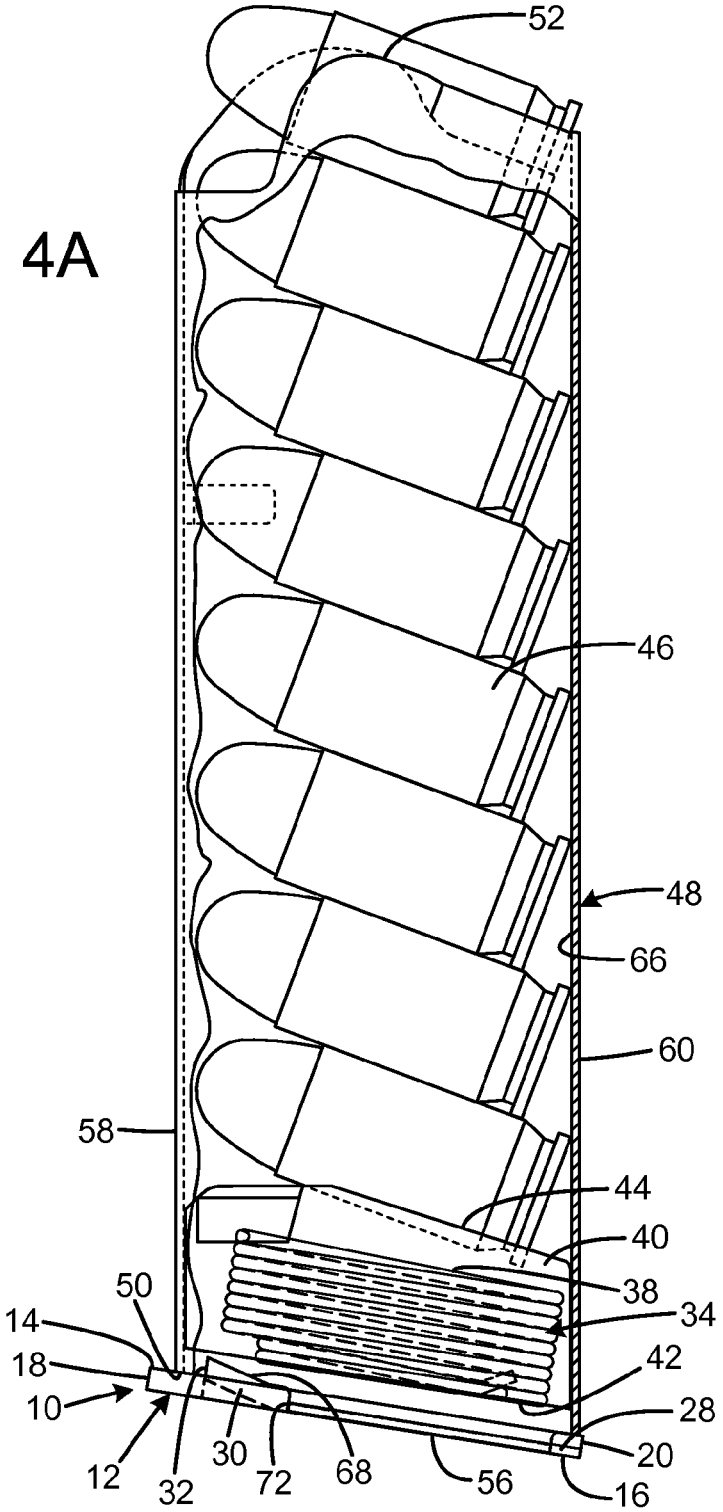
FIG. 4A is a left side sectional view of the magazine floor plate of FIGS. 3A & B installed on a prior art 45 ACP magazine.
Figure 4B:
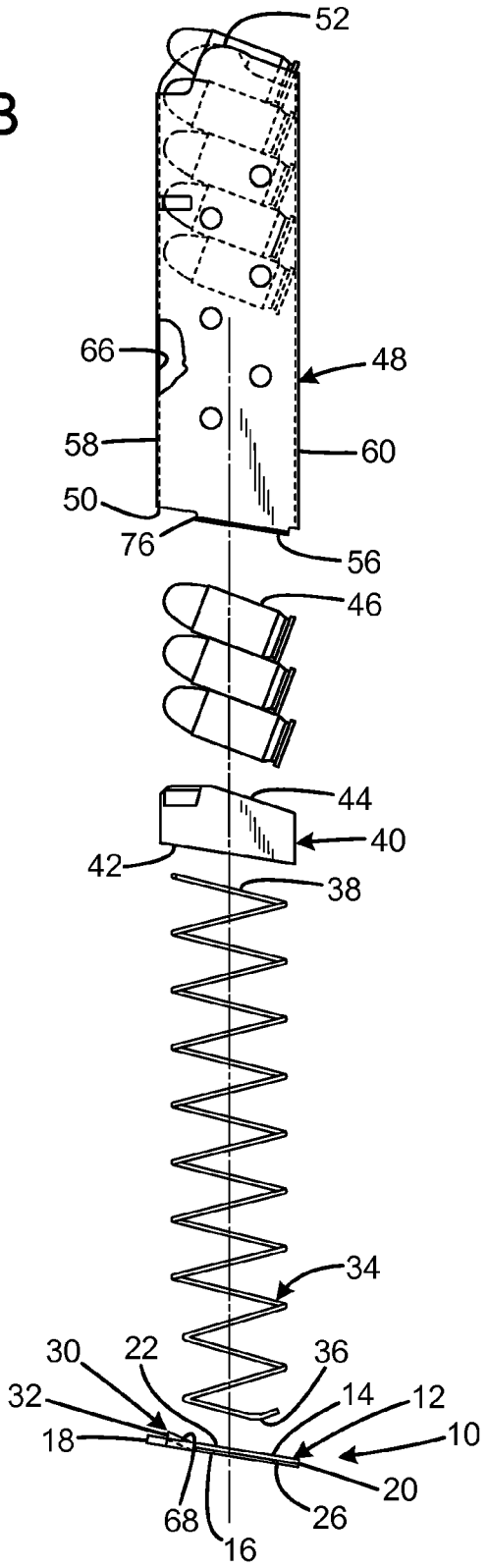
FIG. 4B is an exploded view of FIG. 4A.

FIGS. 4A & 4B illustrate the improved magazine floor plate 10 of the present invention. More particularly, the magazine floor plate 10 is shown installed on a prior art 45 ACP magazine body 48. The magazine body is depicted in a fully loaded condition with the body containing eight cartridges 46. In the current embodiment, the cartridges are 45 ACP cartridges. The cartridges are held at an upwardly sloped angle by the top 44 of a follower 40 with their rears lower than their fronts. Spring force exerted against the bottom 42 of the follower 40 by the top 38 of a coil spring 34 urges the follower and cartridges 46 upwards within the magazine body.

The body 48 is generally tubular with an interior surface 66, and has a front 58, rear 60, left side 62, right side 64, top 52, and bottom 50. The left and right sides of the bottom of the body define elongated left and right rails 54, 56.

The bottom 50 of the magazine body 48 is open to receive the follower 40 and the coil spring 34. The magazine floor plate 10 closes the bottom 50 of the magazine body 48. The body 12 of the magazine floor plate 10 has a width so the body can be closely received within the bottom 50 of the magazine body 48. The left and right rails 54, 56 receive the left and right grooves 26, 28 on the body 12 of the magazine floor plate 10. The location of the left and right grooves permits the magazine floor plate to slide into the left and right rails only from the front and limits the rearward movement of the magazine floor plate. The left and right rails also limit side to side and downward movement of the magazine floor plate. Forward movement of the magazine floor plate is limited by the radiused step on the front 32 of the latch tab 30 on the body 12, while the rearward-facing sloped surface 68 facilitates rearward movement of the magazine floor plate during installation. The front 18 of the body is entirely below the radiused front 58 of the magazine body, and the rear 20 of the body is entirely below the rear 60 of the magazine body in the installed position, which prevents upward movement of the magazine floor plate.

Elimination of the prior art spring plate 116, along with a unique follower design, increases the capacity of the prior art 45 ACP magazine body 48 from seven cartridges 46 to eight without requiring any modifications to the magazine body. Furthermore, the additional space provided by removal of the prior art spring plate enables the cartridges to depress when the slide of an associated firearm is closed. This enables the otherwise unmodified firearm to carry eight rounds plus one in the chamber instead of either seven rounds in a conventional magazine plus one in the chamber or eight rounds in a modified magazine with none in the chamber. Omitting the prior art spring plate also eliminates the need for a through hole in the body 12.

Figure 5B:
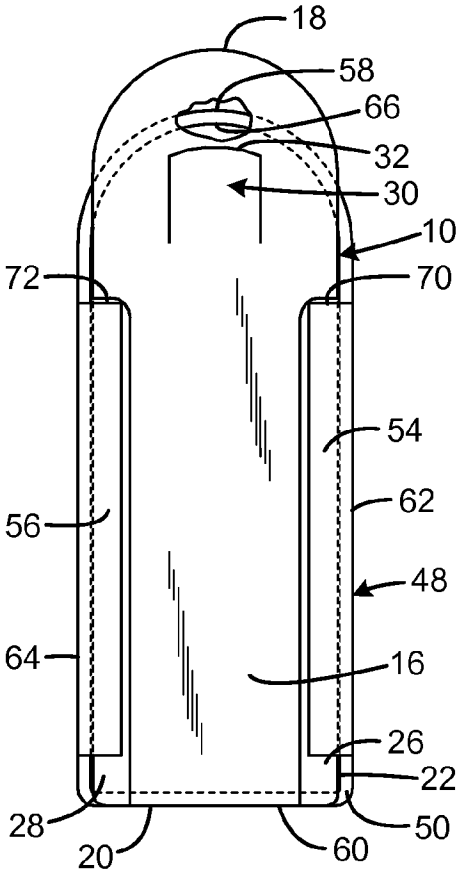
FIG. 5B is a bottom view of FIG. 5A.
Figure 5A:
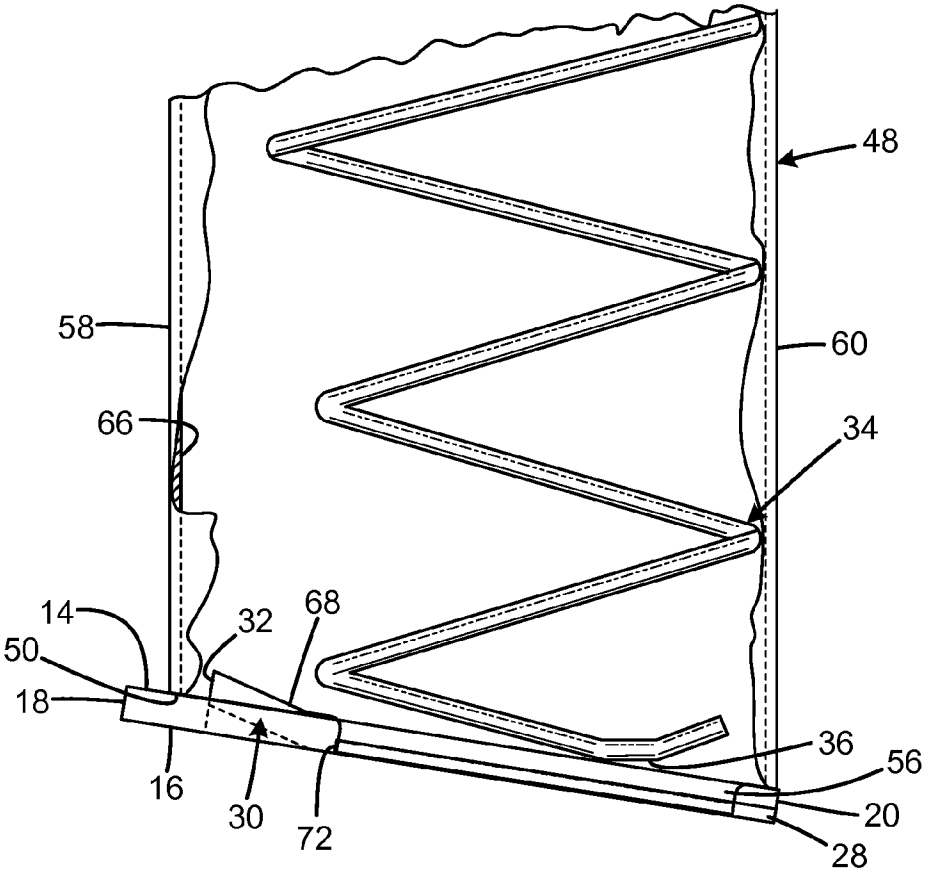
FIG. 5A is an enlarged left side sectional view of the magazine floor plate of FIGS. 3A & B installed on a prior art 45 ACP magazine.

FIGS. 5A & 5B illustrate the improved magazine floor plate 10 of the present invention. More particularly, the magazine floor plate is shown installed on a prior art 45 ACP magazine body 48. In the installed position, the rear 20 of the body 12 is flush with the rear 60 of the magazine body. Spring force exerted against the top 14 of the body 12 by the bottom 36 of the spring 34 creates sufficient frictional engagement with the left and right rails to maintain the rear justified position of the magazine floor plate under normal circumstances.

Figure 6B:
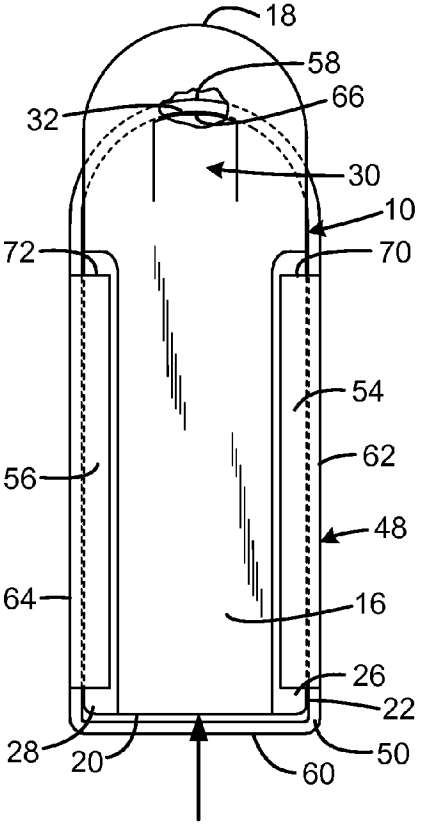
FIG. 6B is a bottom view of FIG. 6A.
Figure 6A:
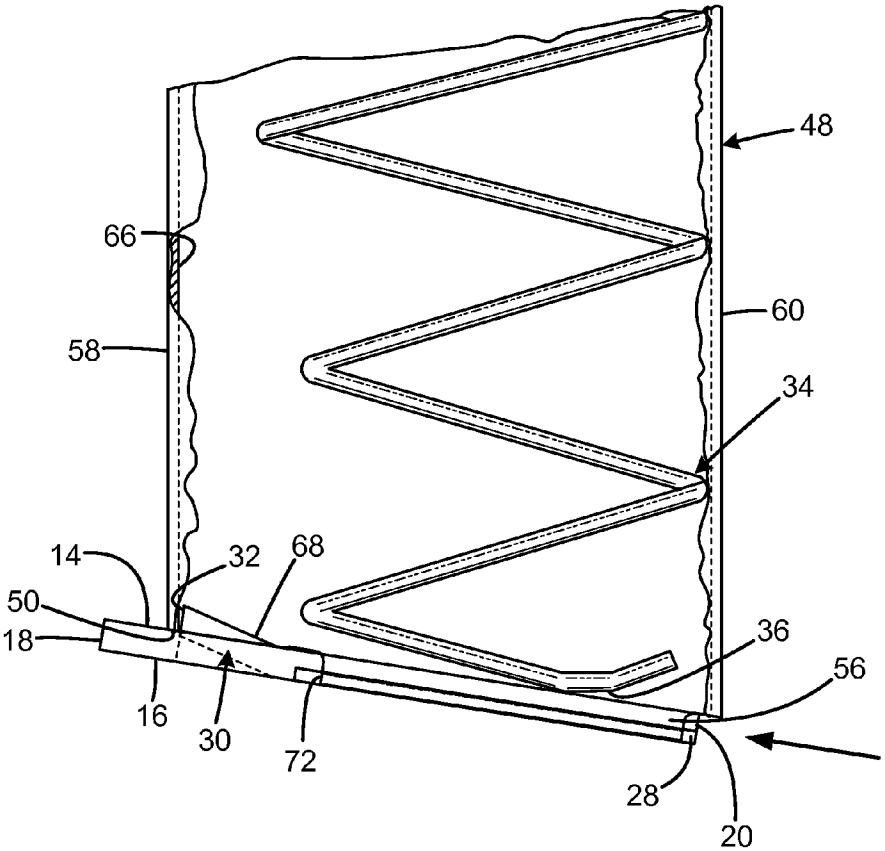
FIG. 6A is an enlarged left side sectional view of the magazine floor plate of FIGS. 3A & B installed on a prior art 45 ACP magazine showing the first step of the floor plate removal process.

FIGS. 6A & 6B illustrate the improved magazine floor plate 10 of the present invention. More particularly, the first step of the magazine floor plate removal process is depicted. After all of the cartridges 46 have been removed from the magazine body 48, the arrow denotes how the body 12 is pushed gently towards the radiused front 58 of the magazine body until the step on the front 32 of the latch tab 30 is flush with the interior surface 66 of the front of the magazine body. In this position, the rear 20 of the body is clear of the rear 60 of the magazine body.

Figure 7:
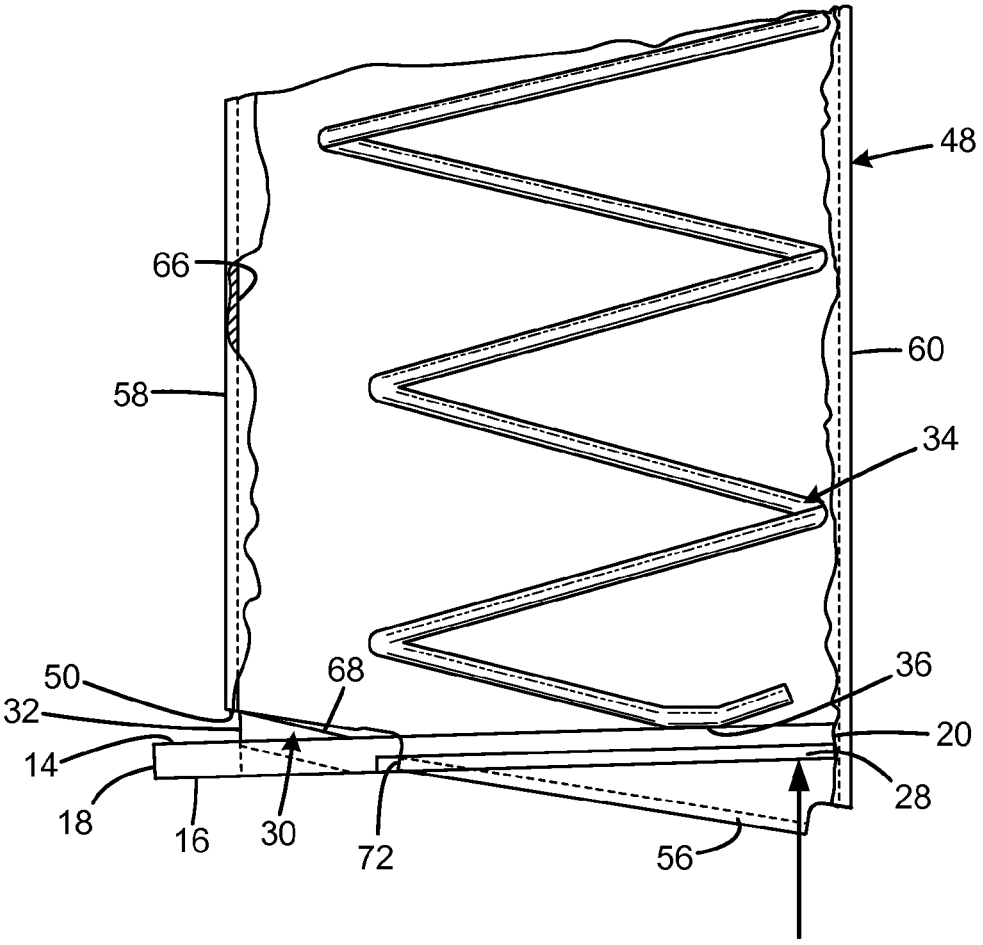
FIG. 7 is an enlarged left side sectional view of the magazine floor plate of FIGS. 3A & B installed on a prior art 45 ACP magazine showing the second step of the floor plate removal process.

FIG. 7 illustrates the improved magazine floor plate 10 of the present invention. More particularly, the second step of the magazine floor plate removal process is depicted. The arrow denotes how the bottom 16 rear 20 of the body 12 is gently pushed upward into the open bottom 50 of the magazine body 48. As the bottom rear of the body is pushed upward into the open bottom of the magazine body, the front 18 of the body tilts downward about the front edges 70, 72 of the left and right rails 54, 56. The bottom rear of the body continues to be pushed upward into the open bottom of the magazine body until the step on the front 32 of the latch tab clears the front 58 of the magazine body and no longer contacts the interior surface 66.

Figure 8:
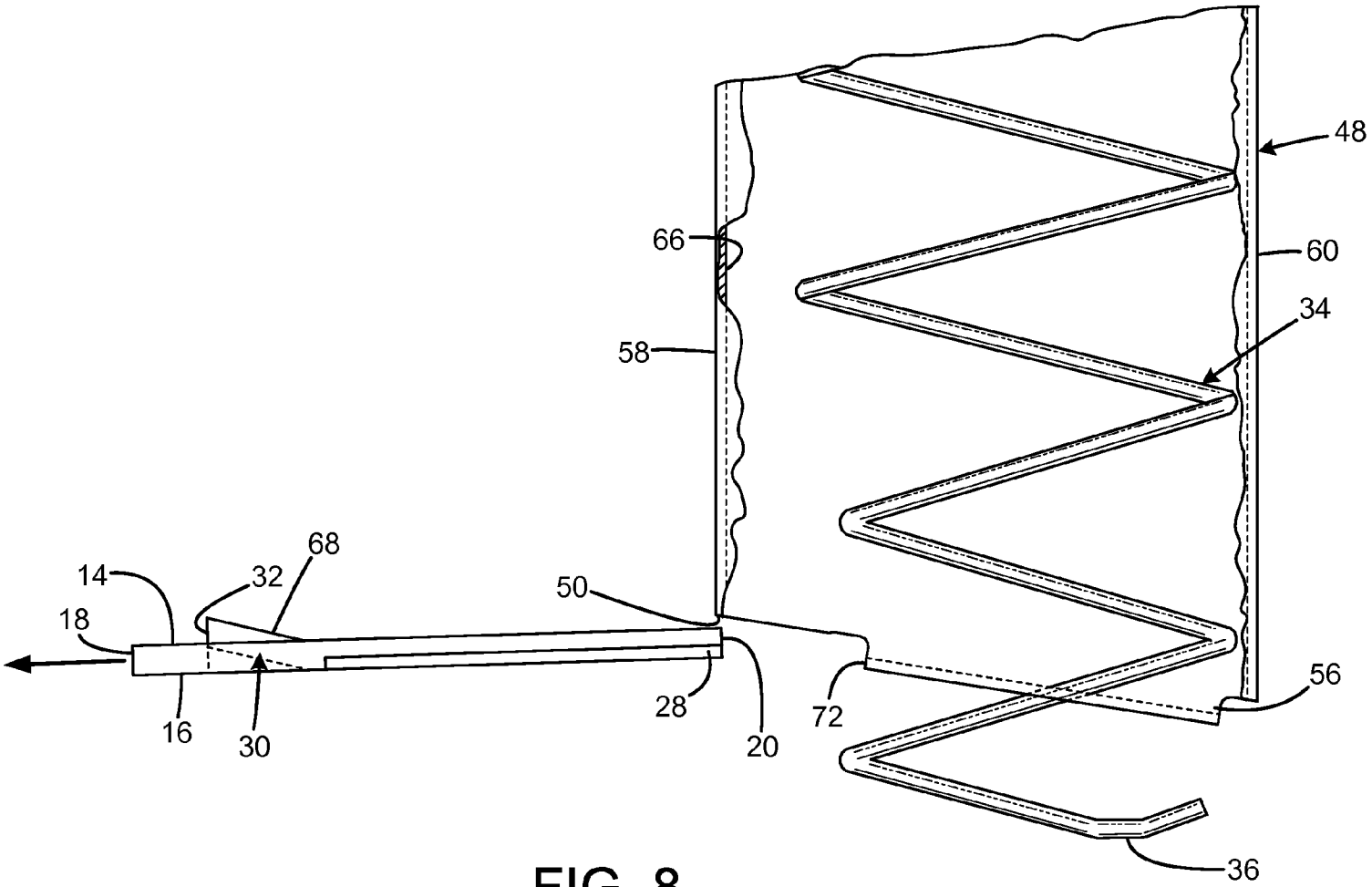
FIG. 8 is an enlarged left side sectional view of the magazine floor plate of FIGS. 3A & B installed on a prior art 45 ACP magazine showing the third step of the floor plate removal process.

FIG. 8 illustrates the improved magazine floor plate 10 of the present invention. More particularly, the third step of the magazine floor plate removal process is depicted. The arrow denotes how the front 18 of the body 12 is grasped and pulled gently forward to withdraw the rear 20 of the body from the open bottom 50 of the magazine body 48 and pull the body free of the left and right rails 54, 56. The removal process is reversed to install the magazine floor plate.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a magazine floor plate has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, the magazine floor plate of the current invention is suitable for use with firearm magazines having calibers other than the 45 ACP caliber described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of removing a floor plate element from a magazine for a firearm comprising the steps of:

obtaining magazine for a firearm having a tubular body defining an elongated passage and having a lower end and an upper end, a floor plate element connected to the lower end by rails on the lower end of the body, the floor plate element having an upward protrusion, a follower movable within the elongated passage, and a spring within the passage having a first end contacting the floor plate element, and having an opposed second end contacting and biasing the follower toward the upper end of the body;

pushing the floor plate element forward from an installed position where a rear side of the floor plate element is flush with a rear side of the lower end of the body to a removal position where the upward protrusion is flush with an interior surface of the passage and the rear side of the floor plate element is clear of the rear side of the lower end of the body;

pushing a bottom rear portion of the floor plate element upward into the passage, thereby tilting a forward portion of the floor plate element downward about a front edge of the rails, until the upward protrusion is clear of a front side of the lower end of the body and no longer contacts the interior surface of the passage;

gripping the forward portion of the floor plate element; and pulling the floor plate element forward to withdraw the rear side of the floor plate element from the passage until the floor plate element is free of the rails.

2. The method of claim 1 wherein the floor plate element has a width narrower than the elongated passage.

3. The method of claim 1 wherein the floor plate element is rigid and does not bend while the floor plate element is being removed from the lower end of the body.

4. The method of claim 1 wherein the interior surface of the body is radiused and wherein the upward protrusion has a corresponding radiused surface.

5. The method of claim 1 wherein the upward protrusion has a rearward-facing sloped surface.

6. The method of claim 1 wherein the elongated passage has a capacity of eight ammunition cartridges when loaded.

7. The method of claim 6 wherein the follower and eight ammunition cartridges received within the elongated passage can be depressed sufficiently to install the loaded magazine in a firearm with a closed slide.

8. The method of claim 6 wherein the ammunition cartridges are 45 ACP cartridges.

* * * * *